US011173364B2

(12) United States Patent
Wang et al.

(10) Patent No.: US 11,173,364 B2
(45) Date of Patent: Nov. 16, 2021

(54) ROLLER-TYPE OMNIDIRECTIONAL PHYSICAL EXERCISE PLATFORM AND SPEED SYNTHESIS METHOD FOR SAME

(71) Applicant: SOUTHEAST UNIVERSITY, Jiangsu (CN)

(72) Inventors: Ziyao Wang, Jiangsu (CN); Haikun Wei, Jiangsu (CN)

(73) Assignee: Southeast University, Nanjing (CN)

( * ) Notice: Subject to any disclaimer, the term of this patent is extended or adjusted under 35 U.S.C. 154(b) by 0 days.

(21) Appl. No.: 17/258,710

(22) PCT Filed: Jul. 8, 2019

(86) PCT No.: PCT/CN2019/094968

§ 371 (c)(1),
(2) Date: Jan. 7, 2021

(87) PCT Pub. No.: WO2020/034783

PCT Pub. Date: Feb. 20, 2020

(65) Prior Publication Data

US 2021/0245025 A1 Aug. 12, 2021

(30) Foreign Application Priority Data

Aug. 14, 2018 (CN) ..... 201810922105.0

(51) Int. Cl.

| | |
|---|---|
| ***A63B 69/00*** | (2006.01) |
| ***A63B 24/00*** | (2006.01) |
| *A63B 22/02* | (2006.01) |

(52) U.S. Cl.

CPC ..... *A63B 69/0035* (2013.01); *A63B 24/0075* (2013.01); *A63B 2022/0271* (2013.01)

(58) Field of Classification Search

CPC .. A63B 69/0035; A63B 24/0075; A63B 26/00

See application file for complete search history.

(56) References Cited

U.S. PATENT DOCUMENTS 2,842,365 A * 7/1958 Kelley ..... A63B 69/0035 482/51
4,274,625 A * 6/1981 Gaetano ..... A61H 15/00 184/12

(Continued)

FOREIGN PATENT DOCUMENTS

CN 102896971 A 1/2013
CN 203447687 U 2/2014

(Continued)

*Primary Examiner* — Sundhara M Ganesan

(74) *Attorney, Agent, or Firm* — Muncy, Geissler, Olds and Lowe, P.C.

(57) ABSTRACT

The present invention discloses a roller-type omnidirectional physical exercise platform, mainly including a housing, a plurality of groups of alternately-placed spiral rollers disposed inside the housing, a motor configured to drive the spiral rollers. The spiral rollers include clockwise spiral rollers and counterclockwise spiral rollers. Roller bodies of the clockwise spiral rollers are obliquely embedded with rotatable wheels at particular angles. Two ends of the roller are mounted with gears and bearings providing a support function. The counterclockwise spiral roller is mirror-symmetrical with the clockwise spiral roller. The present invention presents an active omnidirectional physical exercise platform. Compared with a passive omnidirectional exercise platform, a human body does not need to be strapped, thereby providing more real movement experience, effectively resolving a problem that movements in a virtual space are limited by a real space, and achieving features such as low noise and a slim machine body.

5 Claims, 18 Drawing Sheets

(56) References Cited

U.S. PATENT DOCUMENTS 5,562,572 A * 10/1996 Carmein ..... A61H 3/00 482/4
6,152,854 A * 11/2000 Carmein ..... A63B 22/025 482/4
7,399,258 B1 * 7/2008 Sugar ..... A63B 22/0235 482/51
7,780,573 B1 * 8/2010 Carmein ..... A63B 71/0622 482/4
2004/0192515 A1 * 9/2004 Cane' ..... A63B 69/0035 482/54
2004/0242390 A1 * 12/2004 Willliams ..... A63B 23/0464 482/146
2007/0270285 A1 * 11/2007 Gill ..... A63B 24/00 482/54
2009/0111670 A1 * 4/2009 Williams ..... G06F 3/011 482/146
2010/0022358 A1 * 1/2010 Schwaiger ..... A63B 22/0242 482/54
2010/0147430 A1 * 6/2010 Shultz ..... B60C 7/22 152/450
2010/0170769 A1 * 7/2010 Jung ..... A63B 22/02 198/570
2012/0021873 A1 * 1/2012 Brunner ..... A63B 22/0235 482/9
2012/0302408 A1 * 11/2012 Burger ..... A63B 22/00 482/54
2013/0087430 A1 4/2013 Kirk et al.
2014/0111424 A1 * 4/2014 Goetgeluk ..... A63B 71/0622 345/156
2014/0179490 A1 * 6/2014 Schmitz ..... A63B 24/0021 482/4
2018/0036880 A1 * 2/2018 Stephens, Jr. ..... B25J 9/161
2018/0101224 A1 * 4/2018 Choi ..... G06F 3/011
2018/0147442 A1 * 5/2018 Moon ..... A63B 22/0285
2018/0170678 A1 * 6/2018 Leong ..... G06F 3/011
2018/0217662 A1 * 8/2018 Smoot ..... G06F 3/0334
2019/0134457 A1 * 5/2019 Chen ..... G06F 3/011
2019/0224521 A1 * 7/2019 Olsson ..... A63B 22/025
2019/0255382 A1 * 8/2019 Rudelstorfer ..... A63B 22/0235
2020/0222750 A1 * 7/2020 Salicio Castillo . A63B 22/0221
2020/0276496 A1 * 9/2020 Tugra ..... A63C 17/24

FOREIGN PATENT DOCUMENTS

CN 203681148 U 7/2014
CN 204587079 U 8/2015
CN 104971469 A 10/2015
CN 106693311 A 5/2017
CN 107137875 A 9/2017
CN 207001531 U 2/2018
CN 207270647 U 4/2018
CN 108313664 A 7/2018
CN 109248415 A 1/2019
EP 1367009 A1 12/2003
ES 2391668 A1 11/2012

* cited by examiner

ROLLER-TYPE OMNIDIRECTIONAL PHYSICAL EXERCISE PLATFORM AND SPEED SYNTHESIS METHOD FOR SAME

BACKGROUND

Technical Field

The present invention relates to the field of physical exercise equipment technologies, and specifically, to a roller-type omnidirectional physical exercise platform and a speed synthesis method for same.

Related Art

In the modern society with rapidly developing computer network technologies, network technologies foster both the development of technology and economy and the innovation of leisure and entertainment functions, so that there are various types of terminal simulators for virtual reality environments. However, for most terminal simulators, large-area fields are required for movement, the sensitivity is sufficient, movements such as jumping, squatting, and turning cannot be freely implemented, the experience is not vivid and real enough, and a human body is prone to harm without protections during movement. As a result, the development of existing omnidirectional physical exercise platforms is greatly restricted.

To resolve the problems that exist in the prior art, people have proposed various solutions after long-term exploration. For example, in "Omnidirectional treading device (201320425296.2)", the device includes a housing, a treadmill body, a main control system, and a sensor. Both the sensor and the treadmill body are electrically connected to the main control system. The housing includes an upper cover. The upper cover is provided with a hole. The treadmill body is disposed inside the housing. The sensor below a position at which the hole is located transmits information that is sensed by the sensor and is about an applied force during the running of a person to the main control system. The main control system controls and adjusts a running direction of the treadmill body.

In another example, "Virtual reality omnidirectional physical movement input platform (201510333880.9)" resolves problems such as inadequate protection and low safety during physical movement. However, the device is still a passive treadmill, resulting in that a human body is strapped at the waist, and is extremely unnatural during backward walking.

In "Omnidirectional movement input platform based on speed decomposition and synthesis (201611214960.3)", the problem of unnatural walking is effectively resolved and the structure is simple. However, disadvantages inherent to chain transmission exist in methods using a chain. That is, phenomena such as tooth jumping and slippage are likely to occur, and maintenance costs are relatively high. In addition, it is also difficult to resolve a noise problem caused by friction between a chain and other components.

SUMMARY

Objective of the Present Invention

To overcome disadvantages that exist in the prior art, a slimmer, active, easy-to-maintain, and low-noise roller-type omnidirectional physical exercise platform that provides better experience is provided.

Technical Solution

To achieve the foregoing objective, the present invention provides a roller-type omnidirectional physical exercise platform, including: a housing, a plurality of groups of alternately-placed spiral rollers disposed inside the housing, a motor configured to drive the spiral rollers, where the spiral rollers are configured to provide a reverse moving speed for a human body moving on the surface of the platform, thereby achieving movement experience that the human body does not leave a surface region of a machine body. An active exercise structure is used, so that the impact of strapping around the waist on a human body is eliminated, thereby providing more real movement experience.

Further, the housing includes a base and a machine body cover, both sides of the base being provided with support bearing grooves for mounting the spiral rollers and gear grooves for gear transmission. The machine body cover is approximately symmetrical with the base, and a difference lies that the machine body cover is bottomless.

Further, one side end of the base is provided with two motor mounting grooves for fixing and assembling the motors, the two motor mounting grooves being respectively configured to fix the two motors.

Further, each of two ends of the spiral roller is provided with a support bearing and a gear, the support bearing and the gear respectively fitting in the support bearing groove and the gear groove. Two gears on the spiral roller are respectively a driving gear and a driven gear, the driving gear being fixed on the spiral roller and configured to drive the spiral roller under the action of the motor to rotate, the driven gear being movably assembled on the spiral roller and freely rotatable around the spiral roller. each of two ends of the spiral roller is provided with a support bearing fixing region for mounting the support bearing and is respectively provided with a driving gear fixing region and a driven gear fixing region, the driving gear being fixed on the spiral roller by the driving gear fixing region, the driven gear being assembled on the driven gear fixing region of the spiral roller by a bearing.

Further, the spiral rollers include counterclockwise spiral rollers and clockwise spiral rollers r, roller bodies of the counterclockwise spiral rollers and the clockwise spiral rollers being obliquely embedded with rotatable wheels respectively in a counterclockwise direction and a clockwise direction. The counterclockwise spiral rollers and the clockwise spiral rollers are assembled in the base at intervals in a staggered manner, the driven gear of the counterclockwise spiral roller and the driving gear of the clockwise spiral roller being engaged in a gear groove, the driving gear of the counterclockwise spiral roller and the driven gear of the clockwise spiral roller being engaged in another gear groove, two motors being respectively configured to drive the two rows of gears. In this way, the two motors can respectively drive all the counterclockwise spiral rollers and the clockwise spiral rollers.

Further, angles at which the wheels are embedded in the roller bodies of the counterclockwise spiral rollers and the clockwise spiral rollers are respectively counterclockwise oblique 45 degrees and clockwise oblique 45 degrees.

The present invention further provides a speed synthesis method for a roller-type omnidirectional physical exercise platform, in which speeds of the two motors are respectively adjusted according to a required outputted synthesized speed, that is, a speed in an opposite direction of the movement of the human, to drive the counterclockwise spiral rollers and the clockwise spiral rollers to rotate, where specifically:

in a machine body plane, a direction obtained by counterclockwise rotating 45 degrees from the axial direction of the counterclockwise spiral roller is used as the y direction, that is, the axial direction of the wheel on the counterclockwise spiral roller is used as the y direction; and a direction obtained by clockwise rotating 45 degrees from the axial direction of the clockwise spiral roller is used as the x direction, that is, the axial direction of the wheel on the clockwise spiral roller is used as the x direction; and a coordinate system is established accordingly, and when the surface of the platform requires an outputted synthesized speed with a magnitude of $V_w$ and an angle of w, a rotational linear speed of the counterclockwise spiral roller needs to be $V_1=V_w*\sin(w)/\sin(pi/4)$, and a rotational linear speed of the clockwise spiral roller needs to be $V_2=V_w*\cos(w)/\sin(pi/4)$, so that a rotational speed of the motor driving the counterclockwise spiral rollers is $W_1=a*V_1$, and a rotational speed of the motor driving the clockwise spiral rollers is $W_2=a*V_2$, where a is related to a gear radius and a transmission ratio, and is a constant.

Beneficial effects: Compared with the prior art, the present invention has the following advantages:

1. An active exercise structure is used, so that the impact of strapping around the waist on a human body is eliminated, thereby providing more real movement experience, effectively resolving a problem that movements in a virtual space are limited by a real space, and enhancing experience.

2. Instead of a conventional method using a chain, a spiral roller rotation manner is used to resolve conventional problems of difficult maintenance and high maintenance costs caused by phenomena such as tooth jumping and slippage that are likely to occur, so that maintenance difficulty is reduced and the maintenance costs are significantly reduced.

3. Instead of a conventional method using a chain, a spiral roller rotation manner is used to resolve a conventional noise problem caused by friction between a chain and other components, thereby achieving low-noise performance and optimizing experience.

and

Figure 20:
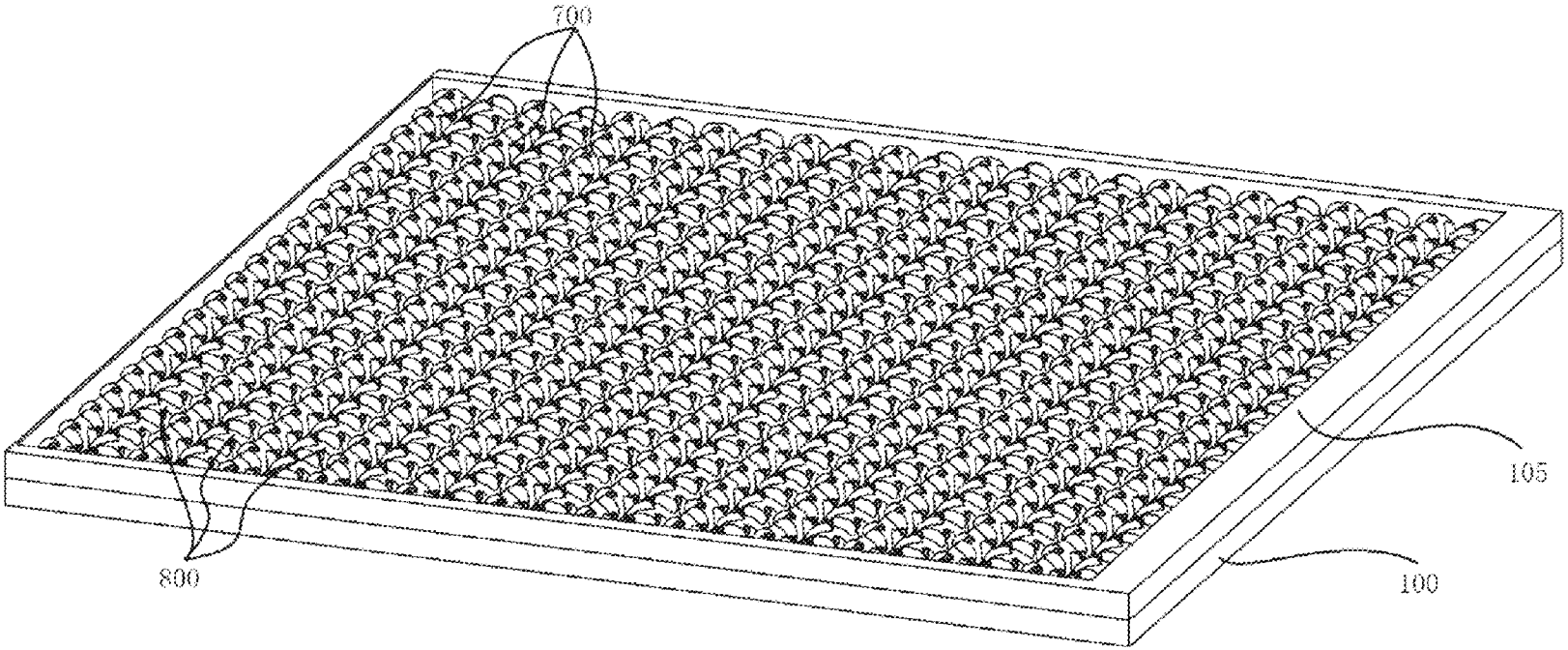

FIG. 20 is an overall schematic assembly diagram according to the present invention.

DETAILED DESCRIPTION

The present invention is further described below with reference to the accompanying drawings and specific embodiments.

The present invention provides a roller-type omnidirectional physical exercise platform, including: a housing, a plurality of groups of alternately-placed spiral rollers disposed inside the housing, and two motors 200 configured to drive the spiral rollers. The housing includes a base 100 and a machine body cover 105.

Figure 1:
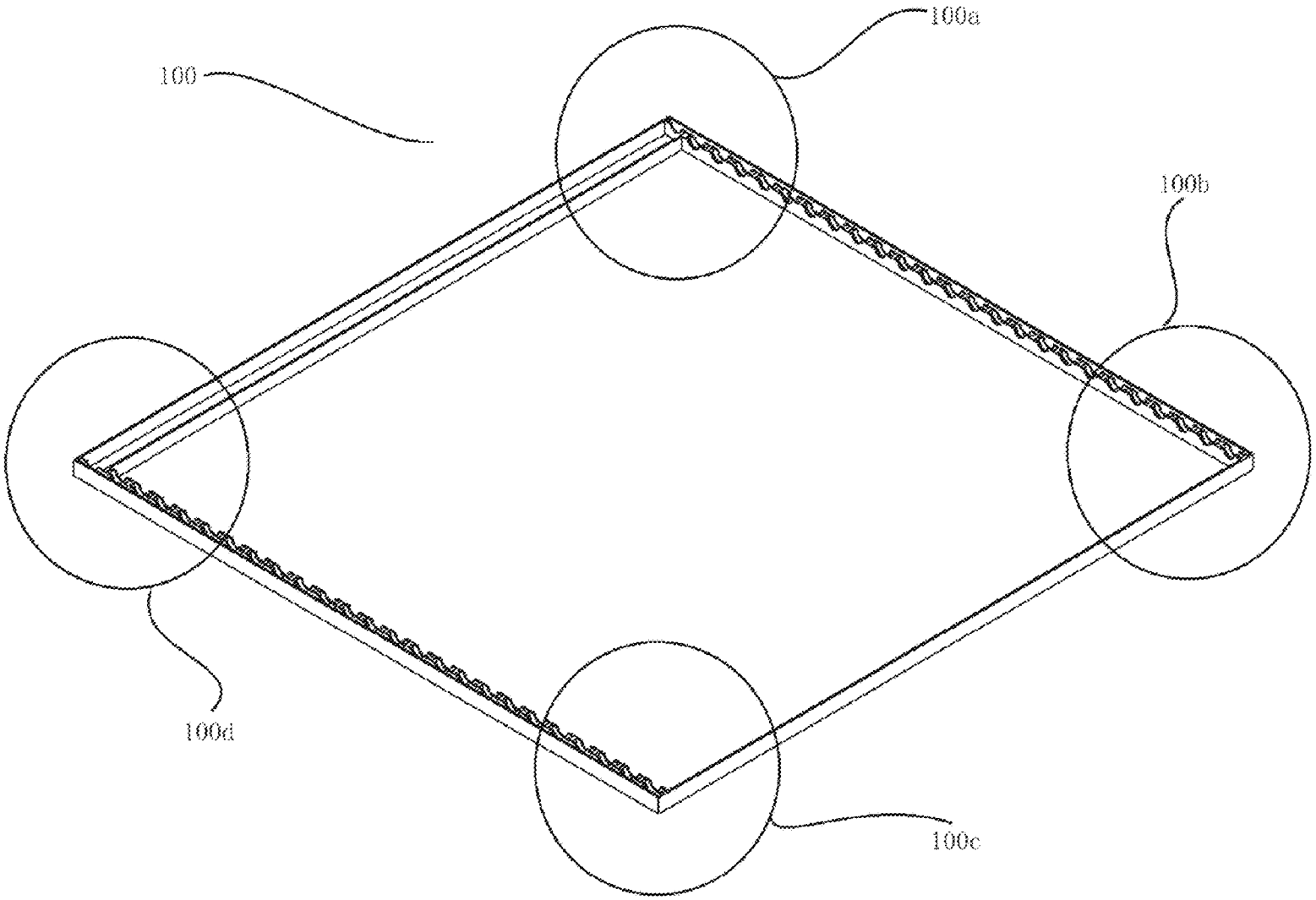
FIG. 1 is an overall schematic diagram of a base according to the present invention.
Figure 2:
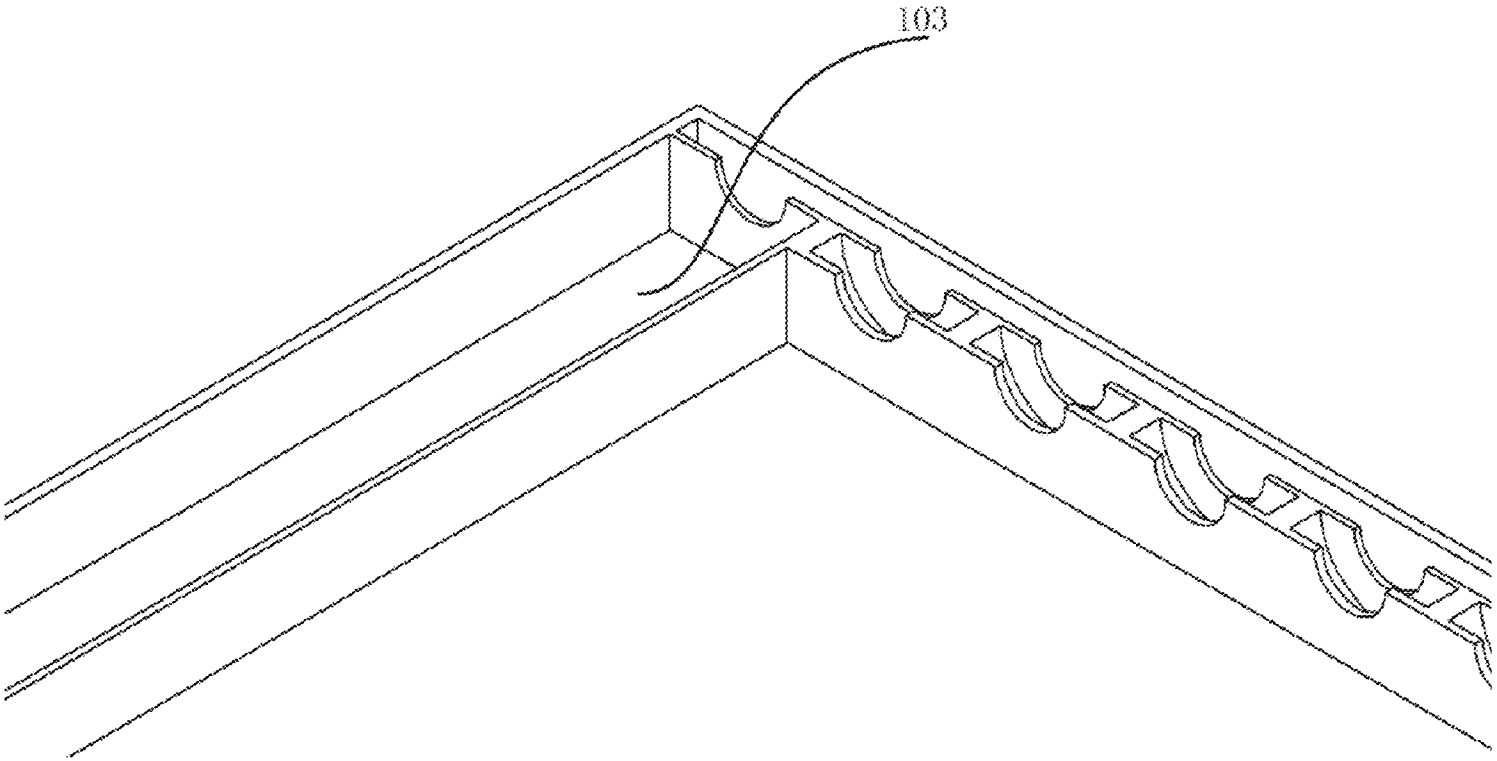
FIG. 2 to FIG. 5 are respectively detailed schematic diagrams of parts of a base according to the present invention.
Figure 3:
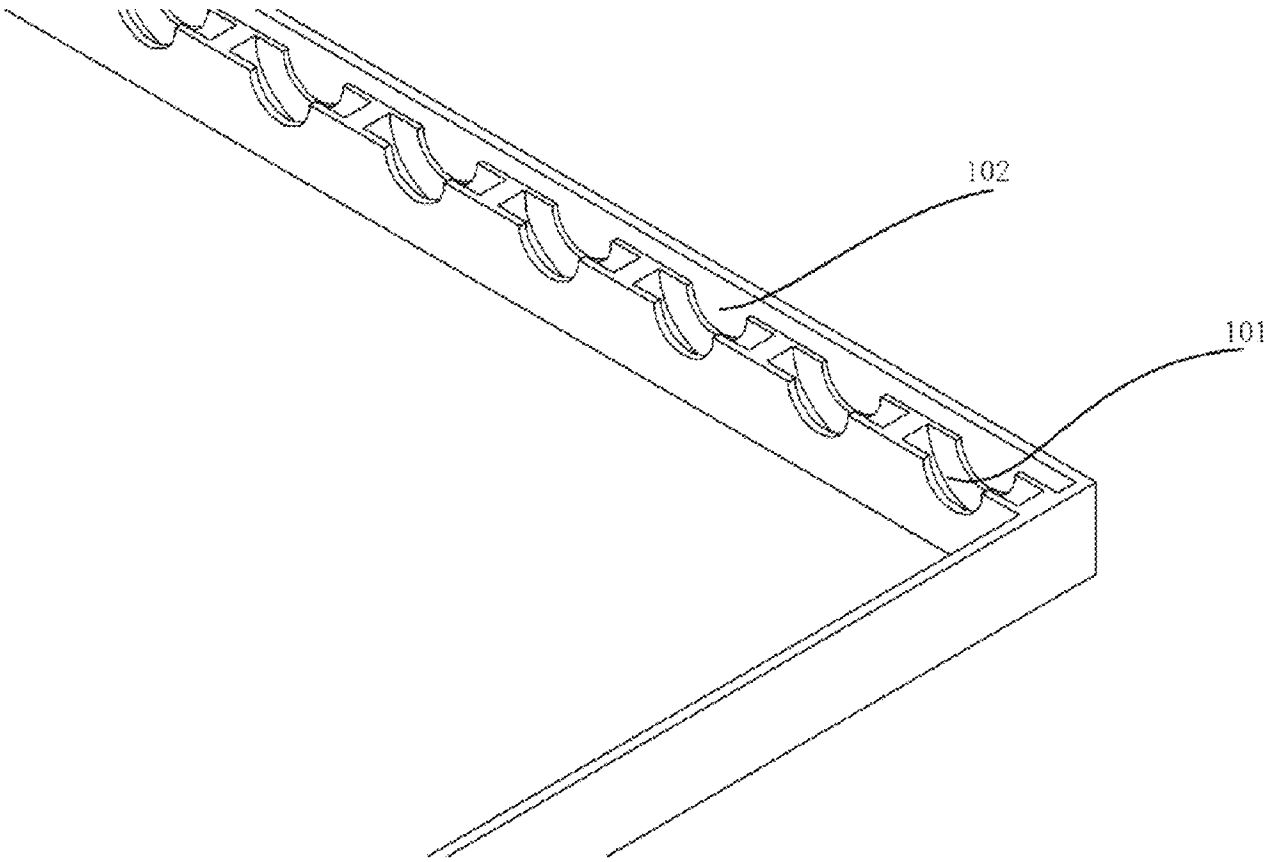
Figure 4:
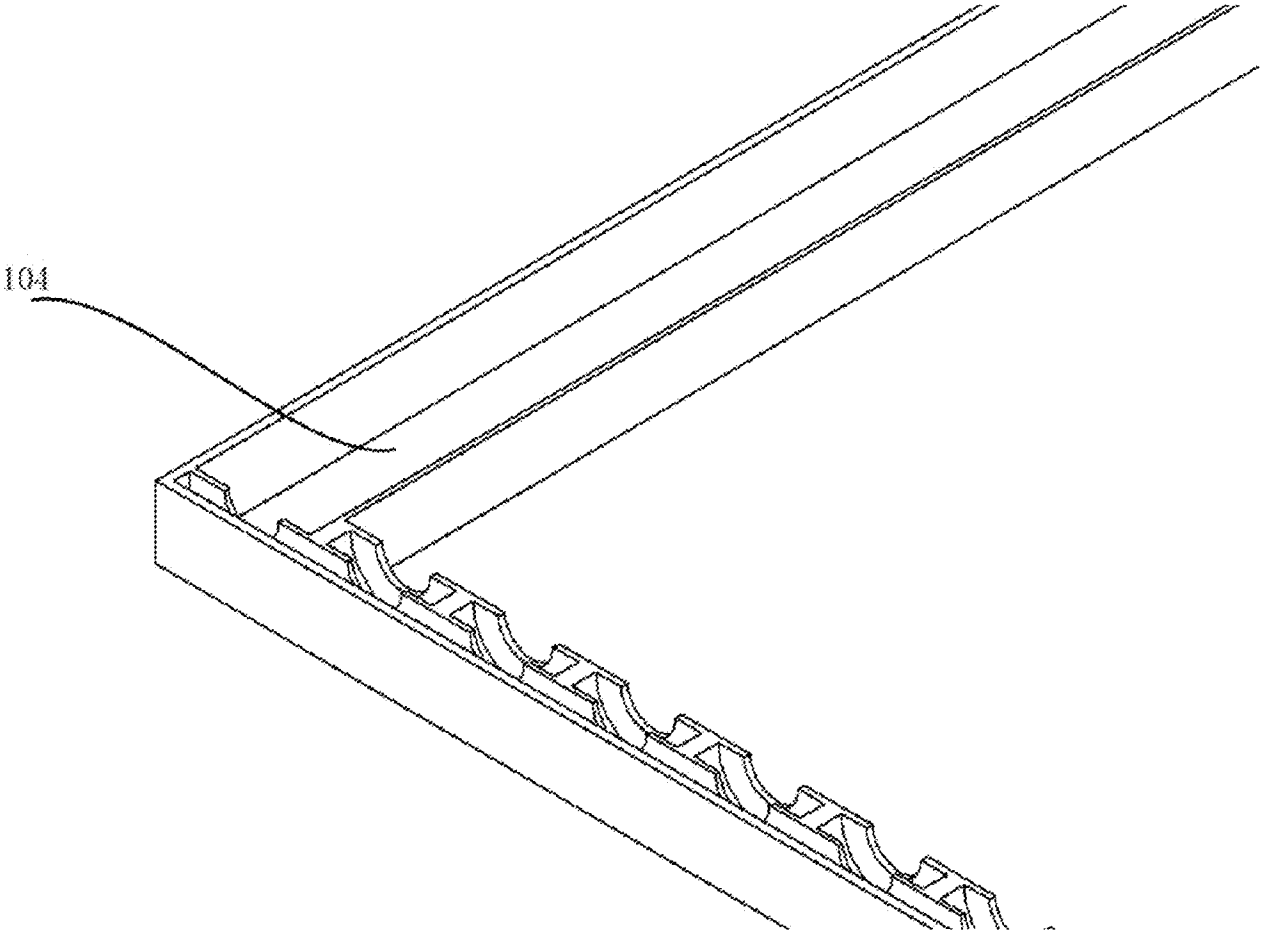
Figure 5:
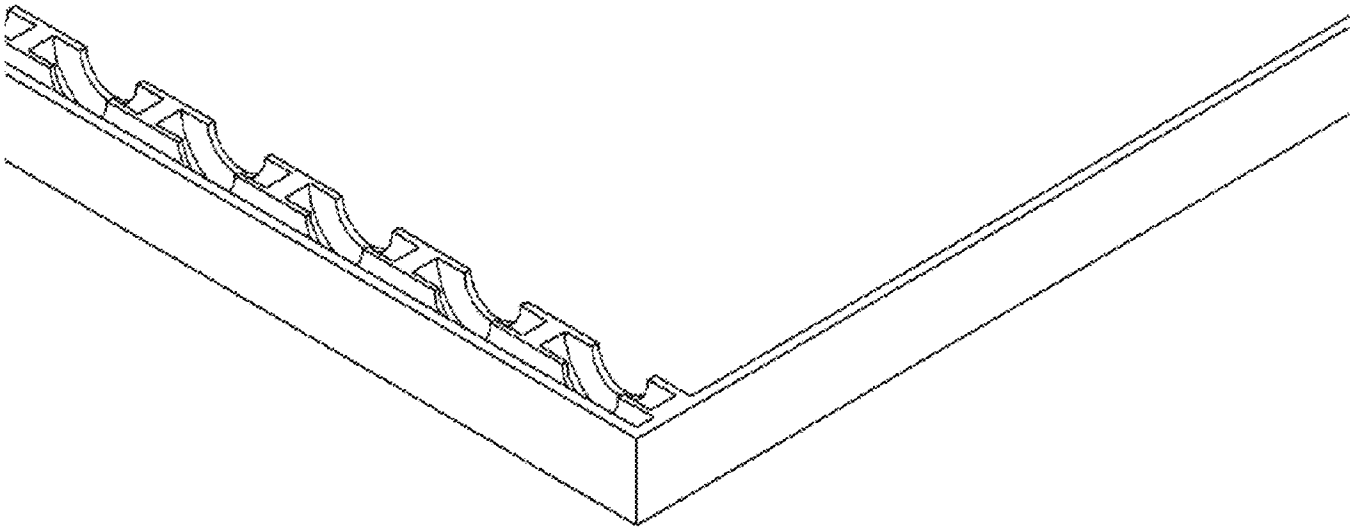

FIG. 1 shows the base 100 of an exercise platform in this embodiment. Details of parts 100*a*, 100*b*, 100*d*, and 100*c* that are circled in FIG. 1 are respectively shown in FIG. 2, FIG. 3, FIG. 4, and FIG. 5. It can be learned from FIG. 1 to FIG. 5 that, both a side of a connecting line between 100*a* and 100*b* and a side of a connecting line between 100*d* and 100*c* are provided with support bearing grooves 101 for mounting spiral rollers and gear grooves 102 for gear transmission. There are two motor mounting grooves, that is, a right motor mounting groove 103 and a left motor mounting groove 104, in the side of the connecting line between 100*a* and 100*d*. The two motors 200 are respectively fixed and assembled in the right motor mounting groove 103 and the left motor mounting groove 104.

Figure 6:
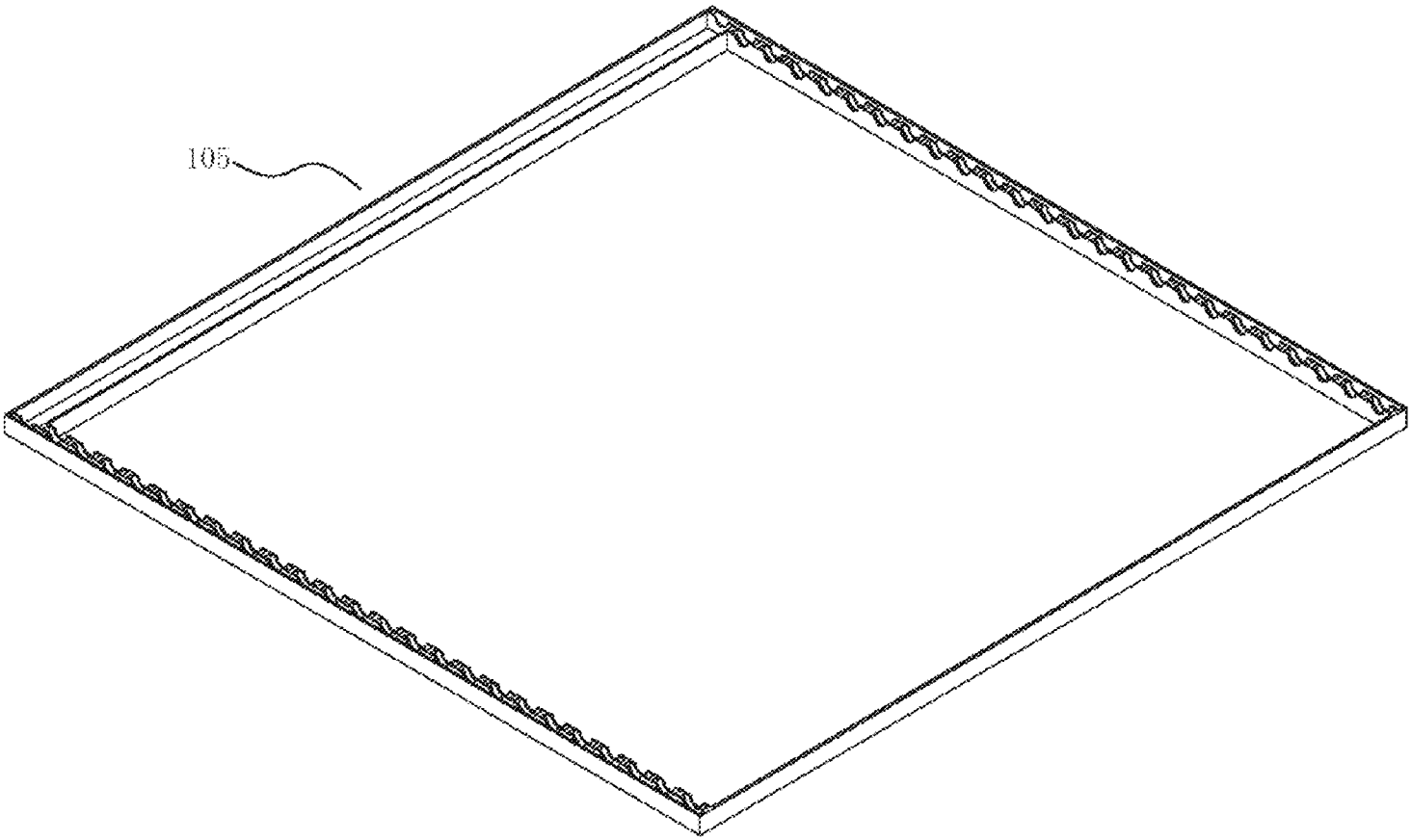
FIG. 6 is a schematic diagram of a machine body cover according to the present invention.

As shown in FIG. 6, the machine body cover 105 is approximately symmetrical with the base 100, and a difference lies in that the machine body cover 105 is bottomless. After the spiral rollers, the motors 200, and the like are assembled on the base 100, the machine body cover 105 and the base 100 are assembled, and the entire machine body can be fixed.

Figure 7:
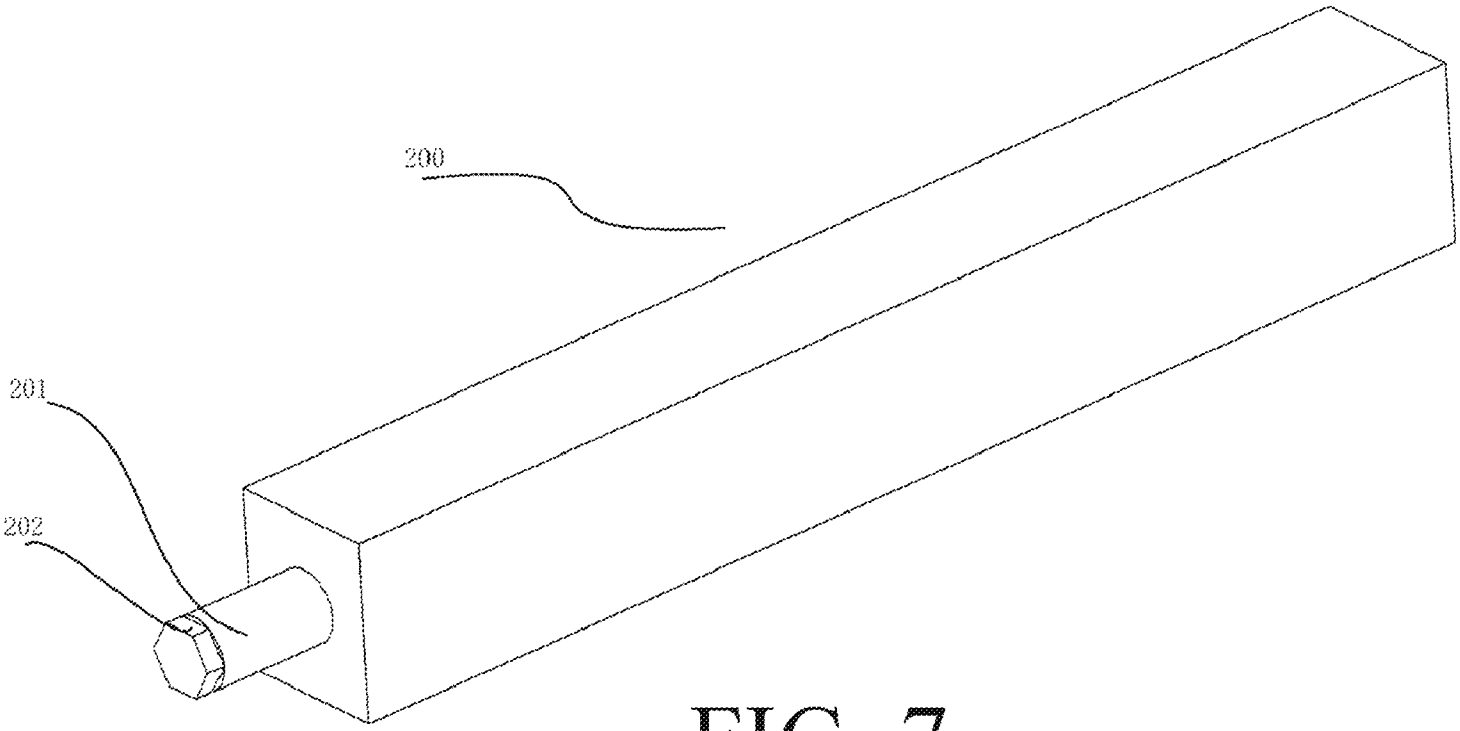
FIG. 7 is a schematic diagram of a motor according to the present invention.

As shown in FIG. 7, the motor 200 includes a rotation shaft 201 and a gear fixing region 202. The gear fixing region 202 fixedly fits a driving gear 400, and is configured for transmission.

Figure 8:
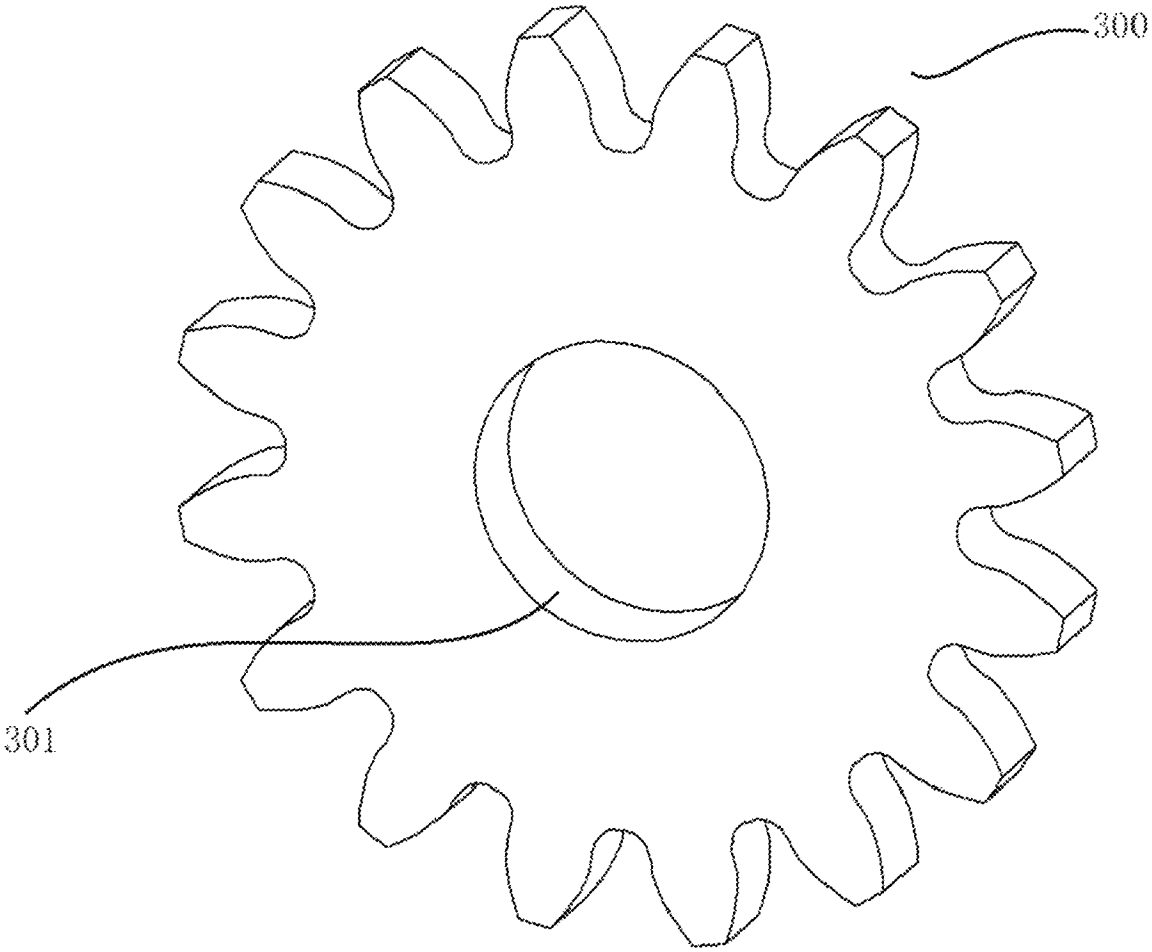
FIG. 8 is a schematic diagram of a driven gear according to the present invention.
Figure 13:
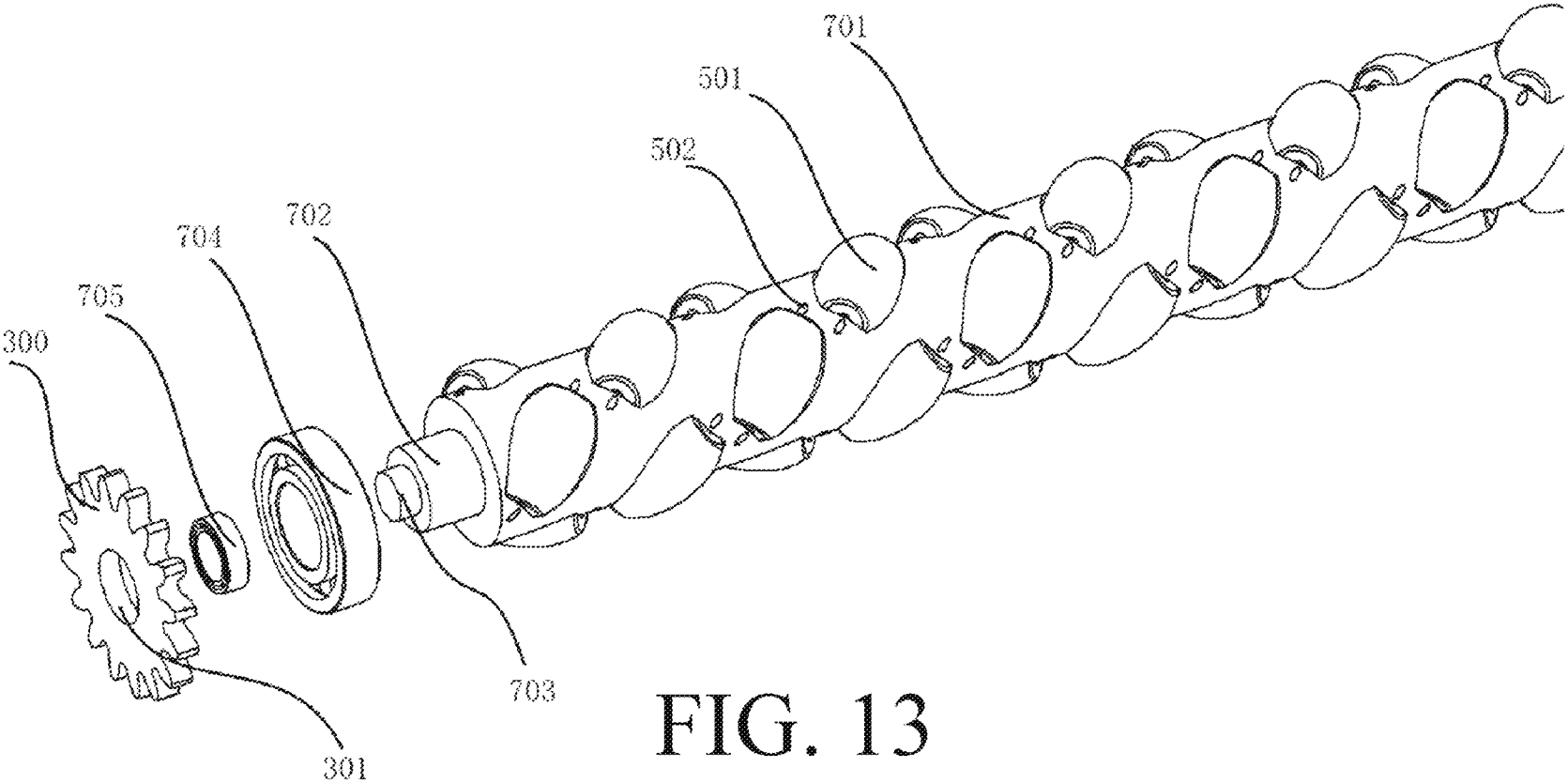

As shown in FIG. 8 and FIG. 13, a bearing fixing hole 301 at the center of a driven gear 300 may fit a bearing 705, so that after the driven gear 300 fits in a driven gear fixing region 703 on the spiral roller, the driven gear is freely rotatable round the spiral roller.

Figure 9:
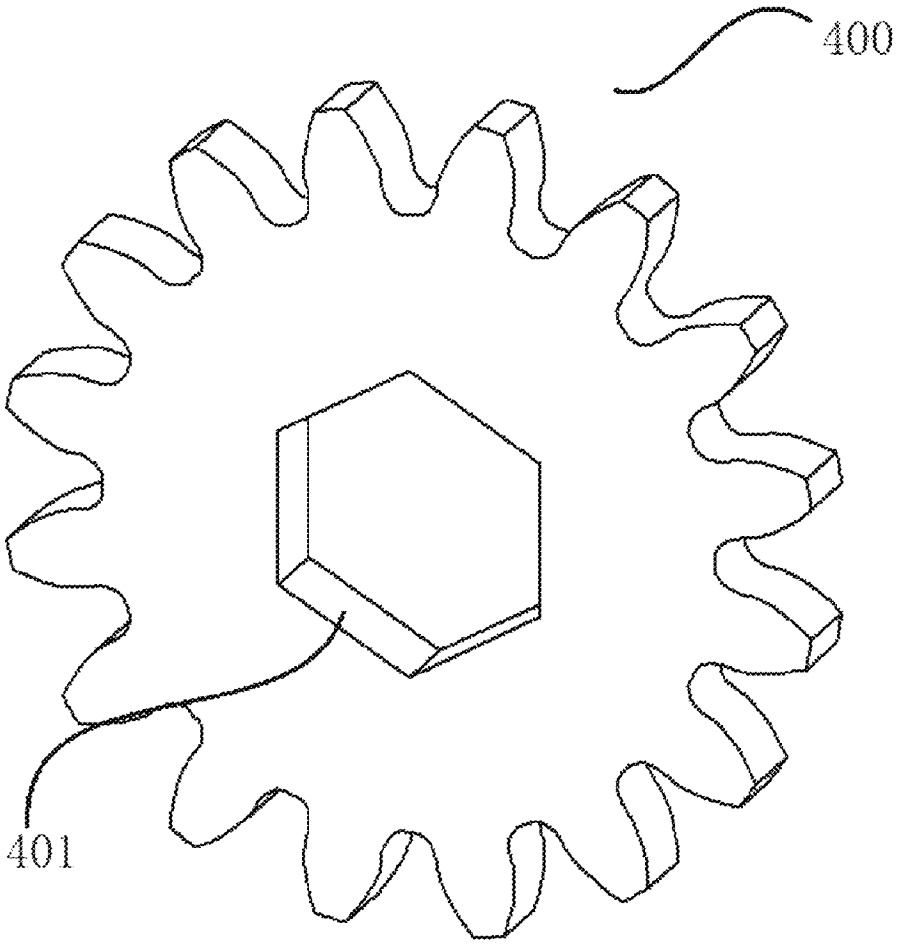
FIG. 9 is a schematic diagram of a driving gear according to the present invention.

As shown in FIG. 9, the center of the driving gear 400 is a polygonal fixing hole 401. The polygonal fixing hole may fit the gear fixing region 202 on the motor 200, so that the motor can drive the gear, or may fit a driving gear fixing region 706 on the spiral roller, so that the gear can drive the spiral roller.

Figure 10:
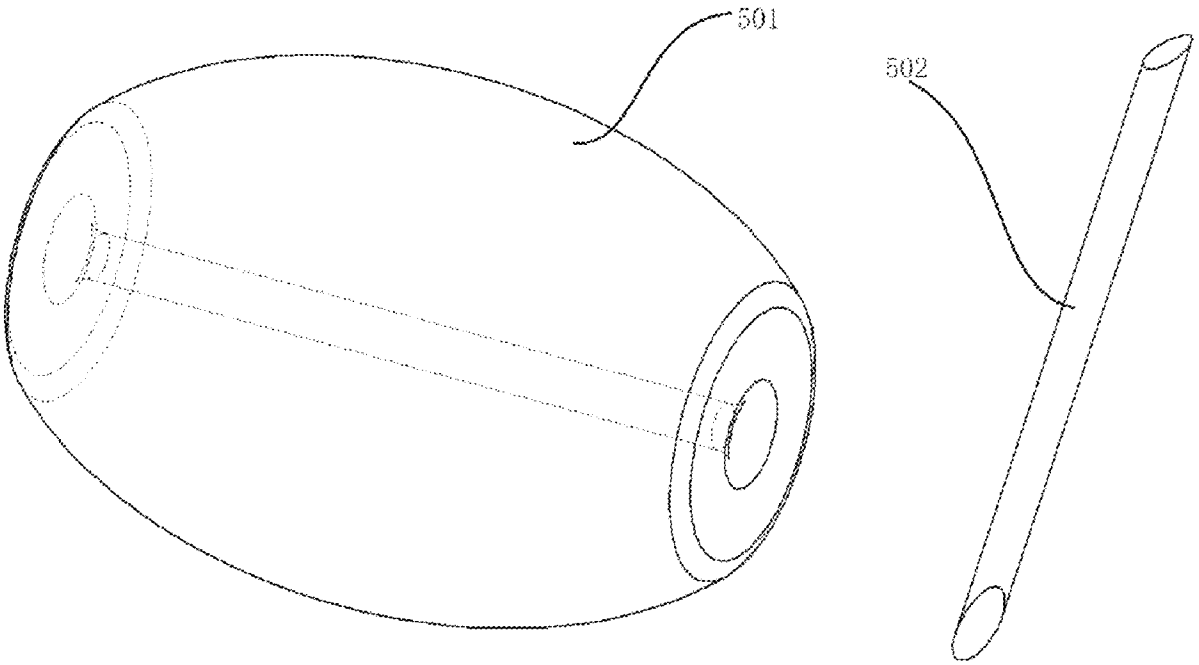
FIG. 10 is a schematic diagram of a wheel and a wheel shaft that are used in the present invention.

As shown in FIG. 10, a wheel 501 is provided with a wheel shaft 502, and the wheel 501 is only rotatable around the wheel shaft 502. For any speed or force forming a particular angle with the direction of the wheel shaft 502. In a case that there is friction with the wheel 501, no slide is generated, and only rotation is generated, a speed or force in the direction of the wheel shaft 502 is offset, and only a speed or force in a rotation direction of the wheel is decomposed and kept.

Figure 11:
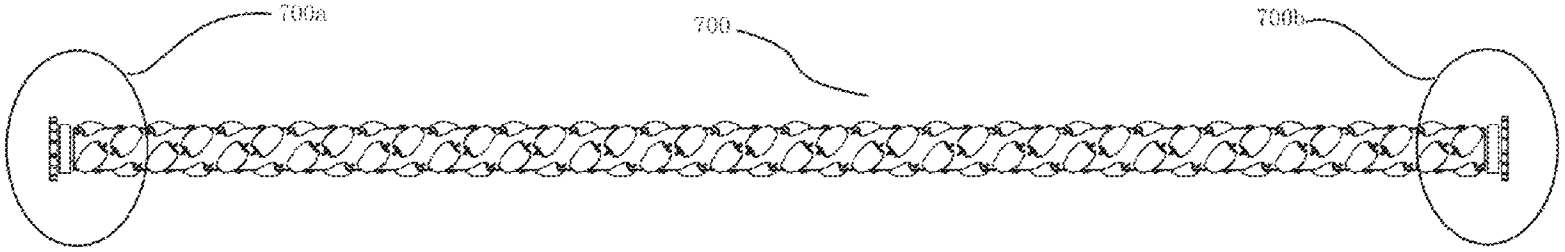
FIG. 11 is an overall schematic diagram of a counterclockwise spiral roller according to the present invention.
Figure 12:
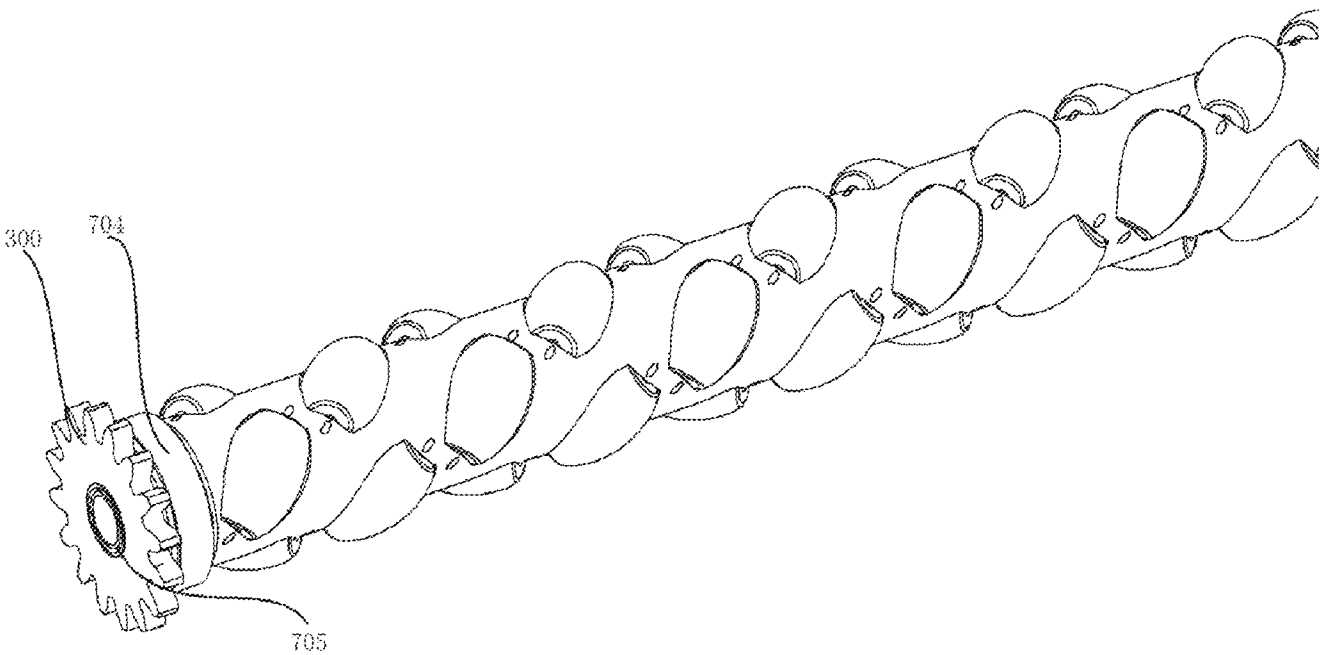
FIG. 12 to FIG. 15 are respectively detailed schematic diagrams of parts of a spiral roller according to the present invention.
Figure 14:
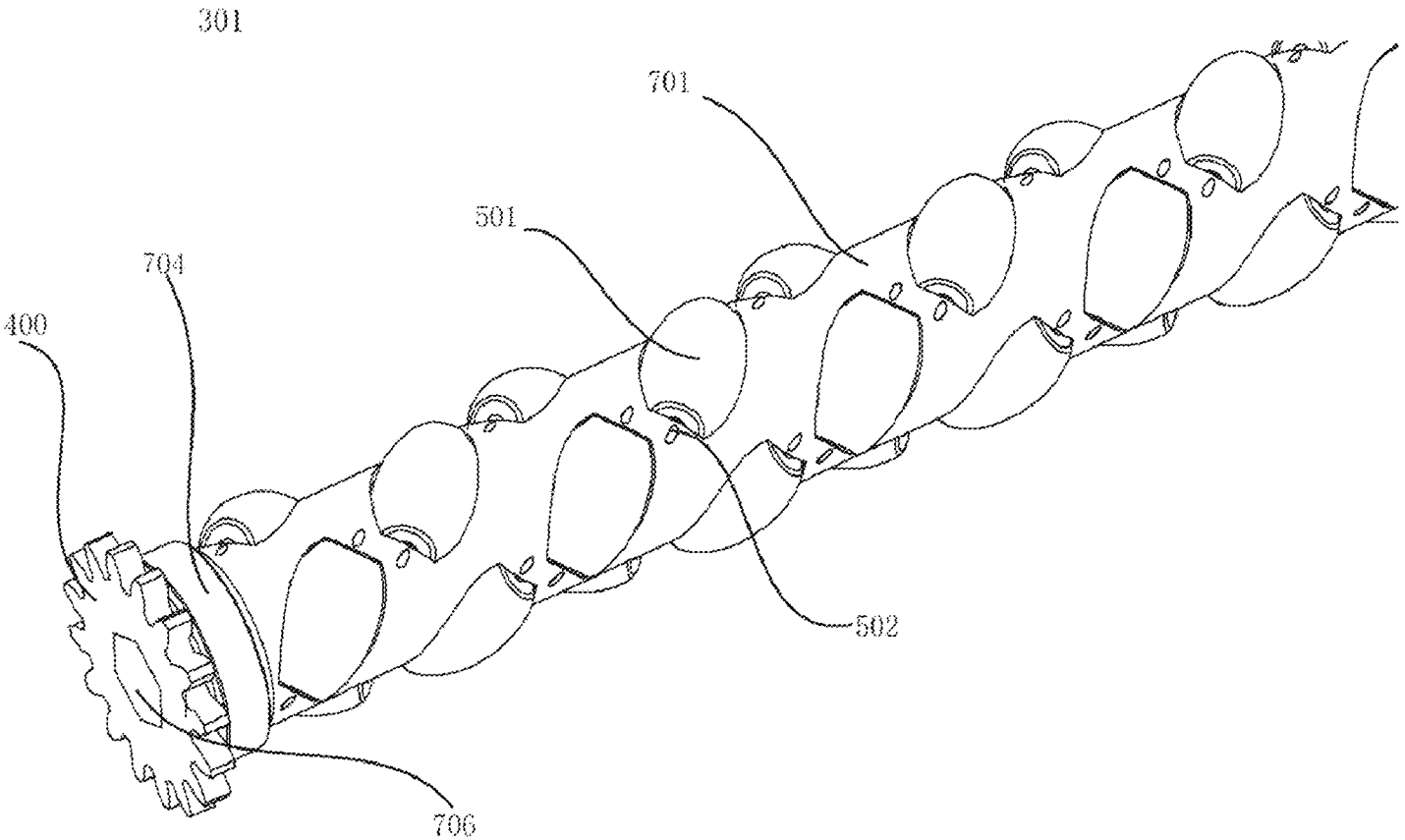
Figure 15:
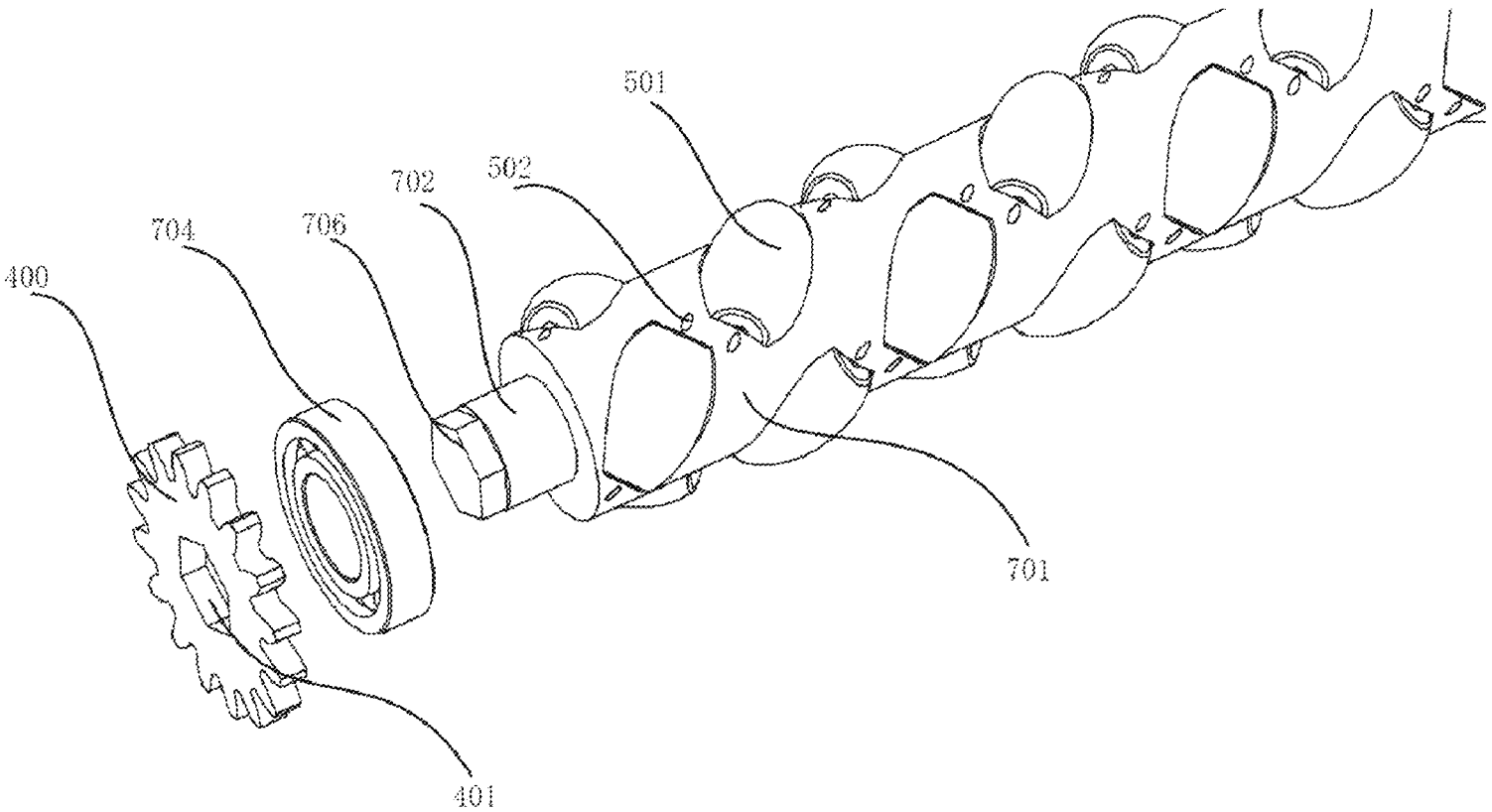

As shown in FIG. 11, detailed parts of 700*a* circled on a counterclockwise spiral roller 700 are shown in FIG. 12 and FIG. 13, and detailed parts of 700*b* are shown in FIG. 14 and FIG. 15. The roller body of the counterclockwise spiral roller 700 is embedded with rotatable wheels 501 at counterclockwise oblique 45 degrees. At both ends of the roller, a support bearing 704 providing a support function and a gear are mounted on a support bearing fixing region 702. Referring to FIG. 14 and FIG. 15, the gear at the end and the counterclockwise spiral roller 700 are fixed through the driving gear fixing region 706, so that the gear can drive the counterclockwise spiral roller 700 to rotate, and is referred to as the driving gear 400. Referring to FIG. 12 and FIG. 13, the gear at the end is assembled on the driven gear fixing region 703 of the counterclockwise spiral roller 700 by the bearing 705, so that the gear is freely rotatable around the roller, and is referred to as the driven gear 300. The counterclockwise spiral roller 700 merely provides a support function to the driven gear 300.

Figure 16:
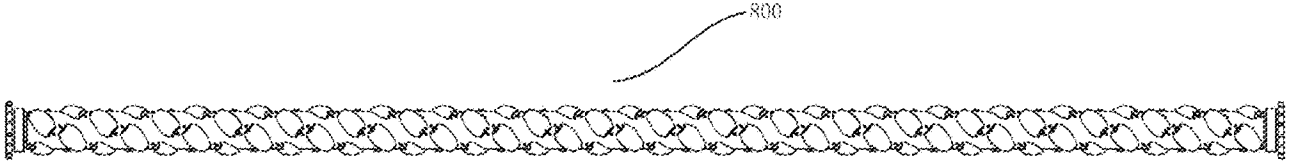
FIG. 16 is an overall schematic diagram of a clockwise spiral roller according to the present invention.

As shown in FIG. 16, the clockwise spiral roller 800 is mirror-symmetrical with the counterclockwise spiral roller 700. That is, a direction in which the wheels 501 are embedded is clockwise oblique 45 degrees. The structure of two ends of the clockwise spiral roller 800 is the same as that of the counterclockwise spiral roller 700. Both the two structures are that a driving gear 400 is fixed at one end, and a driven gear 300 is assembled at the other end. It should be noted herein that for the clockwise spiral roller 800 and the counterclockwise spiral roller 700, provided that it is ensured that there is a particular angle between directions in which the wheels 501 are embedded into the clockwise spiral roller and the counterclockwise spiral roller and a wheel direction is not parallel to the axial direction of a roller, a synthesized vector in any direction in an entire plane can be synthesized according to a synthesis rule of planar vectors. In this embodiment, the embedded wheels 501 are respectively at clockwise oblique 45 degrees and counterclockwise oblique 45 degrees.

Figure 17:
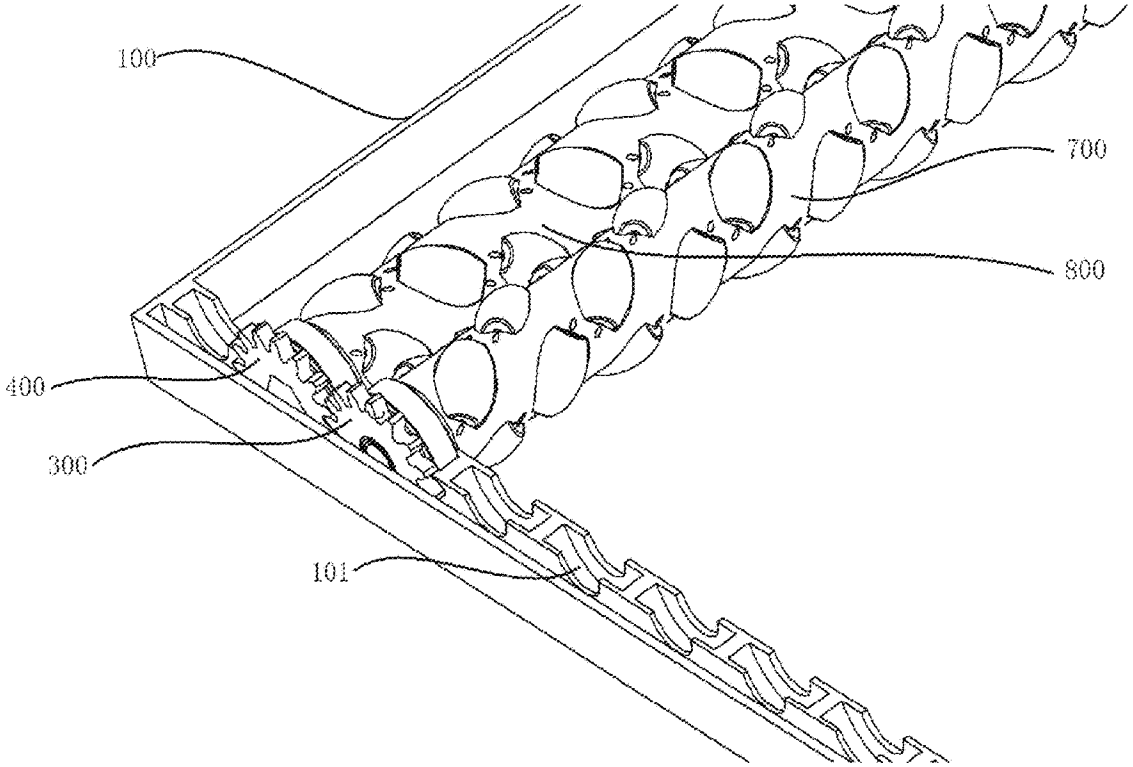
FIG. 17 to FIG. 19 are partial schematic assembly diagrams according to the present invention.

As shown in FIG. 17, the counterclockwise spiral rollers 700 and the clockwise spiral rollers 800 are assembled in the base 100 at intervals in a staggered manner by the support bearings 704. The support bearing 704 is arranged in the support bearing groove 101, a driven gear 300 of the counterclockwise spiral roller 700 is engaged with a driving gear 400 of the clockwise spiral roller 800 in the same gear groove 102, and a driving gear 400 of the counterclockwise spiral roller 700 is engaged with a driven gear 300 of the clockwise spiral roller 800 in another gear groove 102.

Figure 18:
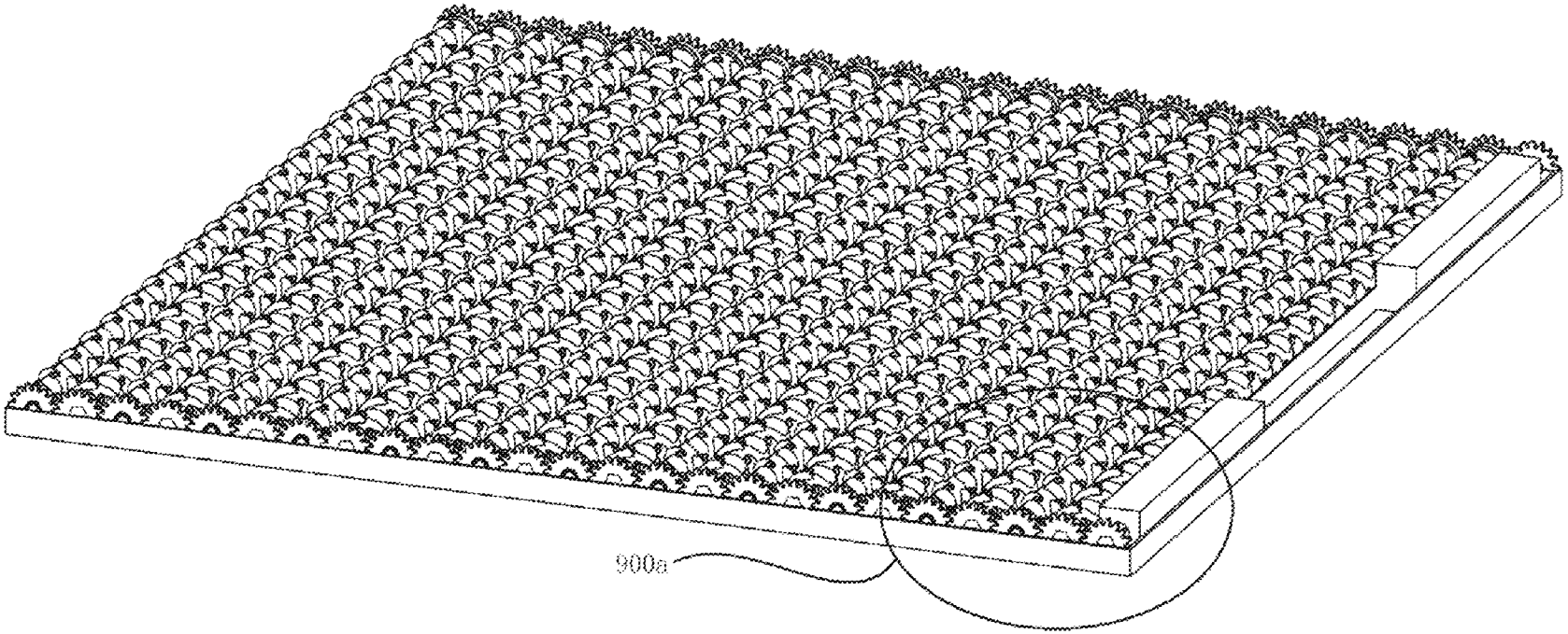
Figure 19:
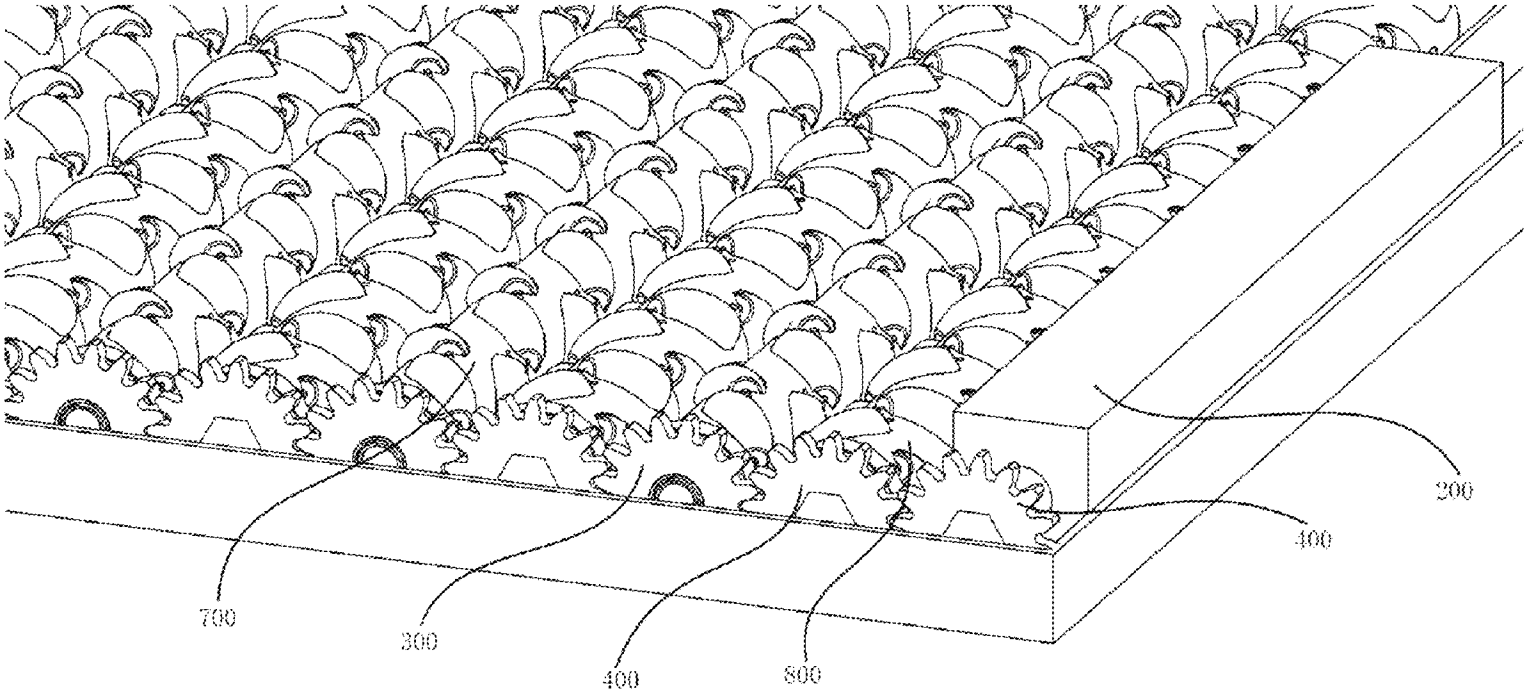

According to the connection manner in FIG. 17, as shown in FIG. 18 and FIG. 19, a plurality of counterclockwise spiral rollers 700 and a plurality of clockwise spiral rollers 800 are assembled in the base 100 at intervals in a staggered manner by the support bearings 704. An end, assembled with a driven gear 300, of the counterclockwise spiral roller 700 and an end, assembled with a driving gear 400, of the clockwise spiral roller 800 are arranged on one surface. The surface is driven by one motor 200 through the driving gear 400. That is, the motor 200 on the surface drives all the clockwise spiral rollers 800. One the other side, an end, assembled with a driving gear 400, of the counterclockwise spiral roller 700 and an end, assembled with a driven gear 300, of the clockwise spiral roller 800 are arranged on one surface. The surface is driven by the other motor 200. That is, the motor 200 can drive all the counterclockwise spiral rollers 700. In this embodiment, spiral rollers in a direction are driven by the same motor 200 driving the driving gears 400. There is one driven gear 300 between every two driving gears 400, and the driven gear is configured for transmission of rotation. It should be noted herein that a manner of the transmission is not limited to using the driven gear 300 to perform transmission between the driving gears 400, and all methods, for example, a method in which a chain is used to drive driving gears 400 on the same side or a method in which one motor is placed for each driving gear 400 are feasible. In consideration of noise, reliability, and the like, the transmission between the driving gears 400 is performed by using the driven gears 300 herein.

As shown in FIG. 20, after all the foregoing assembly operations are completed on the base 100, the machine body cover 105 and the base 100 are assembled, and the fixing of the entire machine body can be completed.

The present invention is used for providing a reverse moving speed for a human body moving on the surface of a machine body, thereby achieving movement experience that the human body does not leave a surface region of the machine body. FIG. 18 shows that speeds of the two motors are respectively adjusted according to a required outputted synthesized speed, that is, a speed in an opposite direction of the movement of the human, to drive the counterclockwise spiral rollers 700 and the clockwise spiral rollers 800 to rotate, where specifically:

in a machine body plane, a direction obtained by counterclockwise rotating 45 degrees from the axial direction of the counterclockwise spiral roller is used as the y direction, that is, the axial direction of the wheel on the counterclockwise spiral roller is used as the y direction; and a direction obtained by clockwise rotating 45 degrees from the axial direction of the clockwise spiral roller is used as the x direction, that is, the axial direction of the wheel on the clockwise spiral roller is used as the x direction; and a coordinate system is established accordingly, and when the surface of the platform requires an outputted synthesized speed with a magnitude of $V_w$ and an angle of w, a rotational linear speed of the counterclockwise spiral roller needs to be $V_1=V_w*\sin(w)/\sin(pi/4)$, and a rotational linear speed of the clockwise spiral roller needs to be $V_2=V_w*\cos(w)/\sin(pi/4)$, so that a rotational speed of the motor driving the counterclockwise spiral rollers is $W_1=a*V_1$, and a rotational speed of the motor driving the clockwise spiral rollers is $W_2=a*V_2$, where a is related to a gear radius and a transmission ratio, and is a constant.

What is claimed is:

1. A roller-type omnidirectional physical exercise platform, comprising: a housing, a plurality of groups of alternately-placed spiral rollers disposed inside the housing, and a motor configured to drive the spiral rollers, wherein the spiral rollers are configured to provide a reverse moving speed for a human body moving on the surface of the platform;

the housing comprises a base and a machine body cover, both sides of the base being provided with support bearing grooves for mounting the spiral rollers and gear grooves for gear transmission;

each of two ends of the spiral roller is provided with a support bearing and a gear, the support bearing and the gear respectively fitting in the support bearing groove and the gear groove;

two gears on the spiral roller are respectively a driving gear and a driven gear, the driving gear being fixed on the spiral roller and configured to drive the spiral roller under the action of the motor to rotate, the driven gear being movably assembled on the spiral roller and freely rotatable around the spiral roller;

the spiral rollers comprise counterclockwise spiral rollers and clockwise spiral rollers, roller bodies of the counterclockwise spiral rollers and the clockwise spiral rollers being obliquely embedded with rotatable wheels respectively in a counterclockwise direction and a clockwise direction; and the counterclockwise spiral rollers and the clockwise spiral rollers are assembled in the base at intervals in a staggered manner, the driven gear of the counterclockwise spiral roller and the driving gear of the clockwise spiral roller being engaged in a gear groove, the driving gear of the counterclockwise spiral roller and the driven gear of the clockwise spiral roller being engaged in another gear groove, two motors being respectively configured to drive the two rows of gears.

2. The roller-type omnidirectional physical exercise platform according to claim 1, wherein one side end of the base is provided with two motor mounting grooves for fixing and assembling the motors.

3. The roller-type omnidirectional physical exercise platform according to claim 1, wherein each of two ends of the spiral roller is provided with a support bearing fixing region for mounting the support bearing and is respectively provided with a driving gear fixing region and a driven gear fixing region, the driving gear being fixed on the spiral roller by the driving gear fixing region, the driven gear being assembled on the driven gear fixing region of the spiral roller by a bearing.

4. The roller-type omnidirectional physical exercise platform according to claim 1, wherein angles at which the wheels are embedded in the roller bodies of the counterclockwise spiral rollers and the clockwise spiral rollers are respectively counterclockwise oblique 45 degrees and clockwise oblique 45 degrees.

5. A speed synthesis method for the roller-type omnidirectional physical exercise platform according to claim 4, wherein speeds of the two motors are respectively adjusted according to a required outputted synthesized speed, that is, a speed in an opposite direction of the movement of the human, to drive the counterclockwise spiral rollers and the clockwise spiral rollers, wherein specifically:

in a machine body plane, a direction obtained by counterclockwise rotating 45 degrees from the axial direction of the counterclockwise spiral roller is used as the y direction, that is, the axial direction of the wheel on the counterclockwise spiral roller is used as the y direction; and a direction obtained by clockwise rotating 45 degrees from the axial direction of the clockwise spiral roller is used as the x direction, that is, the axial direction of the wheel on the clockwise spiral roller is used as the x direction; and a coordinate system is established accordingly, and when the surface of the platform requires an outputted synthesized speed with a magnitude of $V_w$ and an angle of w, a rotational linear speed of the counterclockwise spiral roller needs to be $V_1=V_w*\sin(w)/\sin(pi/4)$, and a rotational linear speed of the clockwise spiral roller needs to be $V_2=V_w*\cos(w)/\sin(pi/4)$, so that a rotational speed of the motor driving the counterclockwise spiral rollers is $W_1=a*V_1$, and a rotational speed of the motor driving the clockwise spiral rollers is $W_2=a*V_2$, wherein a is related to a gear radius and a transmission ratio, and is a constant.

* * * * *